US009457287B1

(12) United States Patent
Lin et al.

(10) Patent No.: US 9,457,287 B1
(45) Date of Patent: Oct. 4, 2016

(54) ILLUMINATING BUILDING BLOCK WITH HIGH LIGHT TRANSMISSION HAVING POSITIONING STRUCTURE FOR SHEET-SHAPED ELECTRIC CONNECTION MEMBER AND METHOD OF ASSEMBLING THE SAME

(71) Applicant: LONGMEN GETMORE POLYURETHANE CO., LTD., Huizhou, Guangdong (CN)

(72) Inventors: Chia-Yen Lin, Huizhou (CN); Yaping Feng, Hengnan County (CN)

(73) Assignee: LONGMEN GETMORE POLYURETHANE CO., LTD., Guangdong (CN)

( * ) Notice: Subject to any disclaimer, the term of this patent is extended or adjusted under 35 U.S.C. 154(b) by 0 days.

(21) Appl. No.: 15/064,926

(22) Filed: Mar. 9, 2016

(30) Foreign Application Priority Data

Dec. 30, 2015 (CN) ..... 2015 1 1028748

(51) Int. Cl.
*A63H 33/04* (2006.01)
*A63H 33/08* (2006.01)

(52) U.S. Cl.
CPC ..... *A63H 33/042* (2013.01); *A63H 33/08* (2013.01)

(58) Field of Classification Search
CPC ..... A63H 33/042; A63H 33/08; H01L 2224/480095; H01L 2924/0002; H01L 2924/00; H05K 1/189; G02B 6/0068; G02B 6/0083; G02F 1/133615
USPC ..... 362/249.08
See application file for complete search history.

(56) References Cited

U.S. PATENT DOCUMENTS 8,495,850 B1 * 7/2013 Lin ..... E04B 2/18 446/124
2011/0021107 A1 * 1/2011 Nag ..... A63H 33/042 446/91

* cited by examiner

*Primary Examiner* — Laura Tso
*Assistant Examiner* — Naomi M Wolford
(74) *Attorney, Agent, or Firm* — Lin & Associates Intellectual Property, Inc.

(57) ABSTRACT

An illuminating building block with high light transmission having a positioning structure for an electric connection member and a method of manufacturing the same provide projection strips disposed on an interior surface of a top cover and arranged at intervals, and slots disposed between the projection strips. The electric connection members are inserted into the slots to preliminarily position the electric connection members and align elastic pieces of the electric connection members with hollow studs of the top cover. The elastic pieces would not be constricted in the top cover due to the misalignment between the elastic pieces and the hollow studs. Therefore, the elastic pieces can accurately pass through the hollow studs and be projected out of the top cover. When the illuminating building blocks are connected together, the connected building blocks can have a stable power transmission and illuminate together.

10 Claims, 12 Drawing Sheets

ILLUMINATING BUILDING BLOCK WITH HIGH LIGHT TRANSMISSION HAVING POSITIONING STRUCTURE FOR SHEET-SHAPED ELECTRIC CONNECTION MEMBER AND METHOD OF ASSEMBLING THE SAME

CROSS-REFERENCE TO RELATED APPLICATION

This application claims the priority of Chinese patent application No. 201511028748.3, filed on Dec. 30, 2015, which is incorporated herewith by reference.

BACKGROUND OF THE INVENTION

1. Field of the Invention

The present invention relates generally to an illuminating building block with high light transmission having a positioning structure for a sheet-shaped electric connection member, and more particularly, to an illuminating building block with high light transmission having a positioning structure disposed therein to make the sheet-shaped electric connection member be accurately positioned and projected out of the building block.

2. The Prior Arts

The conventional illuminating building block with high light transmission, such as the one disclosed in Chinese Patent Publication No. CN 104587683 A (U.S. Pat. No. 9,016,902 B1) and the one shown in FIGS. 11 and 12 of the present disclosure, includes a base 90, a circuit board 100, an illuminating member 110, a top cover 120 and plate-shaped electric connection members 130. The base 90 includes a plurality of recesses 91 defined therethrough. A conductive circuit and the illuminating member 110 are disposed on the circuit board 100. The top cover 120 is a hollow and light transmittable member mounted on the base 90. The top cover 120 includes a plurality of hollow studs 121 corresponding to the recesses 91 of the base 90. One end of the plate-shaped electric connection member 130 is electrically connected with the conductive circuit and another end of the plate-shaped electric connection member 130 is extended to be projected out of the hollow studs 121. When the top cover 120 is connected with another illuminating building block with high light transmission, the plate-shaped electric connection members 130 of one illuminating building block are projected into the recesses 91 and contacted with a bottom of the circuit board 100 of the another building block, so as to electrically connect the connected building blocks and make them illuminate together.

However, when assembling the conventional illuminating building block with high light transmission, the plate-shaped electric connection members 130 are sometimes pressed by the top cover 120 and can not be projected out of the hollow studs 121 due to the ends of the plate-shaped electric connection members 130 that are opposite to the circuit board 100 incapable of being accurately aligned with the hollow studs 121 of the top cover 120. Because the connected illuminating building blocks with high light transmission are not electrically connected, the electric power can not be successfully transmitted from one illuminating building block to another illuminating building block. Therefore, the connected illuminating building blocks are incapable of illuminating together.

SUMMARY OF THE INVENTION

A primary objective of the present invention is to provide an illuminating building block with high light transmission having a positioning structure for a sheet-shaped electric connection member that overcomes the shortcoming and disadvantage of conventional designs. According to the present invention, the sheet-shaped electric connection members can be accurately aligned with hollow studs of a top cover and the electric connection members can be securely projected out of the hollow studs, so that the electric connection members of one building block can be electrically connected with a circuit board of another building block. Therefore, the connected illuminating building block with high light transmission can illuminate together.

In order to achieve the foregoing objective, the solution provided by the present invention is:

providing an illuminating building block with high light transmission having a positioning structure for a sheet-shaped electric connection member, comprising:

a base including at least two recesses defined therethrough;

a top cover being hollow and light transmittable, mounted on the base, including a top portion, a side portion and a bottom opening, the top portion including at least two hollow studs corresponding to the recesses of the base, the side portion extended from an edge of the top portion in a direction toward the base and connected with an edge of the base, the side portion including a plurality of projection strips disposed on at least one interior surface of the side portion, the projection strips projected from the interior surface of the side portion toward an interior of the top cover and arranged at intervals, a plurality of slots provided between the projection strips and disposed spaced away from each other, the bottom opening being surrounded by the side portion;

a circuit board disposed on a top of the base, the circuit board including at least one electrode circuit disposed at a side facing the base and corresponding to positions of the recesses, the electrode circuit being electrically connected with at least one electric connection member that is extended in a direction towards the top portion, wherein the electric connection member has a sheet-shaped structure, the electric connection member includes a projection portion, at least two elastic pieces and a connection portion, the projection portion has two ends, one end of the projection portion is electrically connected with the electrode circuit and another end of the projection portion is connected with the connection portion, the projection portion of the electric connection member is inserted into the slot, the elastic pieces are projected out of the hollow studs, and the connection portion connects the projection portion with the at least two elastic pieces; and at least one illuminating member mounted on the circuit board.

Compared with the conventional illuminating building blocks, the advantages of the illuminating building block with high light transmission according to the present invention include: by inserting the projection portion of the sheet-shaped electric connection member into the spaced-apart slots disposed between the projection strips located on the interior surface of the side portion of the top cover, the elastic pieces of the electric connection member can be correctly aligned with the hollow studs of the top cover. Therefore, the elastic pieces take advantage of the electric connection member inserted into the slots, so that the elastic pieces of the electric connection member are accurately projected out of the hollow studs of the top cover. The situation that the elastic pieces are constricted in the interior of the top cover due to the misalignment between the elastic pieces and the hollow studs, which the elastic pieces cannot be projected out of the hollow studs and the power transmission between the connected illuminating building blocks are affected would be prevented.

Preferably, the connection portion of the electric connection member includes at least one projection piece disposed at a side facing the top portion of the top cover, and the projection piece is provided with a projection point disposed at a side facing the top portion of the top cover; and the top portion of the top cover includes at least one engaging recess disposed at a side facing the electric connection member, and the engaging recess has a depression disposed therein. The size, shape and position of the projection piece are corresponding to those of the engaging recess, and the size, shape and position of the projection point are corresponding to those of the depression. The electric connection member is engaged with the top cover by the projection point being engaged with the depression. Because of the configuration of the projection point of the projection piece of electric connection member and the depression of the engaging recess of the top cover, not only the electric connection member can be aligned and fixed with the top cover by the engagement between the engaging recess and the projection piece, but also the elastic pieces of the electric connection member would not descend toward the circuit board due to gravity and thus cannot be projected out of the hollow studs. Moreover, when two illuminating building blocks with high light transmission are connected with each other, the engagement of the projection point of the projection piece of electric connection member with the depression of the engaging recess of the top cover prevents the elastic pieces projected out of the hollow studs of the lower illuminating block from being excessively pressed downward by the circuit board of the upper illuminating building block. Thus, the configuration makes sure that the elastic pieces of the lower illuminating block are contacted with and electrically connected with the electrode circuit of the upper illuminating building block. Therefore, the break circuit between the connected illuminating blocks is less likely to happen, which affects the illumination of the connected illuminating building blocks.

Preferably, the projection portion, the elastic pieces and the connection portion of the electric connection member have an integrally formed sheet-shaped structure. Because the sheet-shaped structure is integrally formed, the electric connection member may be made by the pressing process and thus have a higher stiffness. Thus, the electric connection member is less likely to be deformed during the assembling process. Furthermore, because the electric connection member has the sheet-shaped structure, it is easier to insert the electric connection member into the slots disposed on the interior surface of the side portion of the top cover, thereby achieving the objective of positioning the electric connection member with the top cover.

Preferably, the elastic pieces and the connection portion of the electric connection member have an integrally formed sheet-shaped structure, and the projection portion includes a clip device disposed at an end adjacent to the connection portion. The clip device is removably connected with the connection portion. The projection portion is provided with a plurality of pressing pieces extended away from the projection portion and pressed against the slots. This configuration takes advantage of the electric connection member having a two-piece structure. The integrally formed elastic pieces and connection portion of the electric connection member may be made by the pressing process, and the projection portion may be made separately to increase the manufacturing efficiency and reduce the material loss. Moreover, the pressing pieces of the projection portion effectively make the electric connection member being securely fixed in the slots and less likely to get loose from the slots.

Preferably, the end of the projection portion contacted with the electrode circuit is formed with a bending section. The bending section is bended along and contacted with the circuit board. The bending section includes a first bump disposed at a side facing the circuit board, and a second bump disposed at a side facing the base. The first bump and the second bump are contacted with the electrode circuit and the base, respectively. When the base is assembled with the top cover in a direction from the bottom opening of the top cover toward the circuit board, the bending section of the electric connection member is sandwiched in between the base and the circuit board. Due to the first bump and the second bump, the second bump is pressed by the base to force the first bump of the bending section to be securely contacted with the electrode circuit of the circuit board. Due to the dimensional tolerances generated during manufacturing the illuminating building block with high light transmission having a positioning structure for a sheet-shaped electric connection member, the bending section of the electric connection member sometimes cannot be securely contacted with the electrode circuit on the circuit board, which decreases the conductivity and the yield of the products. The first bump and the second bump can prevent the poor electric connection between elements.

Preferably, the base includes a plurality of grooves disposed at peripheries thereof. Each of the grooves is provided with an engaging piece. An interior surface of the side portion of the top cover includes a plurality of protrusion bumps disposed at a side facing the base. Each of the protrusion bumps is provided with an engaging indentation. The sizes, shapes and the positions of the engaging pieces are corresponding to those of the engaging indentations. This configuration takes advantage of the sizes, shapes and the positions of the engaging pieces of the base being corresponding to those of the engaging indentations of the top cover to enhance the structural strength of the connected base and top cover. Therefore, it is uneasy to separate the connected base and top cover apart. Furthermore, this configuration also prevents the illuminating building blocks from breaking apart if they are accidentally dropped.

Preferably, the circuit board has at least one positioning hole and the base includes at least one positioning post disposed at a side facing the circuit board. Position of the positioning hole is corresponding to that of the positioning post. This configuration takes advantage of the positioning post of the base passing through the positioning hole of the circuit board to align the base with the circuit board and to fix them together, which prevents the circuit board from shaking in the illuminating building block.

Corresponding to the illuminating building blocks with high light transmission mentioned above, the present invention also provide a method of assembling an illuminating building block with high light transmission having a positioning structure for a sheet-shaped electric connection member. The method includes the steps of:

inserting the electric connection member: inserting the projection portion of the electric connection member into the top cover from the bottom opening of the top cover along slot disposed on the interior surface of the side portion of the top cover toward the top portion of the top cover, and projecting the elastic pieces of the electric connection member out of the hollow studs of the top covers;

assembling the circuit board: placing the circuit board from the bottom opening into the interior of the top cover, and making the at least one electrode circuit of the circuit board be contacted with the end of the projection portion of the electric connection member, thereby forming a conductive path; and assembling the base: mounting the base to an inner edge of the bottom opening from the bottom opening of the top cover.

Compared with the conventional assembling methods, the assembling method according to the present invention has the advantage of: inserting the projection portion of the sheet-shaped electric connection member into the slots disposed on the interior surface of the side portion of the top cover, which effectively and accurately aligns the elastic pieces of the electric connection member with the hollow studs of the top cover. The elastic pieces take advantage of the electric connection member being inserted into the slots to accurately pass through the hollow studs and are projected out of the top cover. The advantage of the method according to the present invention further includes: assembling the circuit board and the base to seal the electric connection member in the top cover, thereby assembling the illuminating building block with high light transmission having a positioning structure for a sheet-shaped electric connection member that can be connected with each other and illuminate together.

Preferably, the connection portion of the at least one electric connection member of the illuminating building block with high light transmission having a positioning structure for a sheet-shaped electric connection member includes at least one projection piece disposed at a side facing the top portion of the top cover. The top portion of the top cover includes at least one engaging recess disposed at a side facing the electric connection member. The size, shape and position of the projection piece are corresponding to those of the engaging recess. The electric connection member is engaged and fixed with the top cover by the engagement between the projection piece and the engaging recess. The assembling method further takes advantage of inserting the projection piece of the electric connection member into the engaging recess of the top cover not only to align and connect the electric connection member with the top cover, but also to securely project the elastic pieces out of the hollow studs of the top cover. Therefore, in addition to using the slots of the top cover to align the elastic pieces with the hollow studs, the projection piece of the electric connection member and the engaging recess of the top cover can facilitate the alignment, engagement and fixation between the electric connection member and top cover. It makes sure that each of the elastic pieces can be projected out of the hollow studs. Therefore, the connected illuminating building block with high light transmission according to the present invention will not have break circuit, which affects the illumination of the connected illuminating building blocks.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
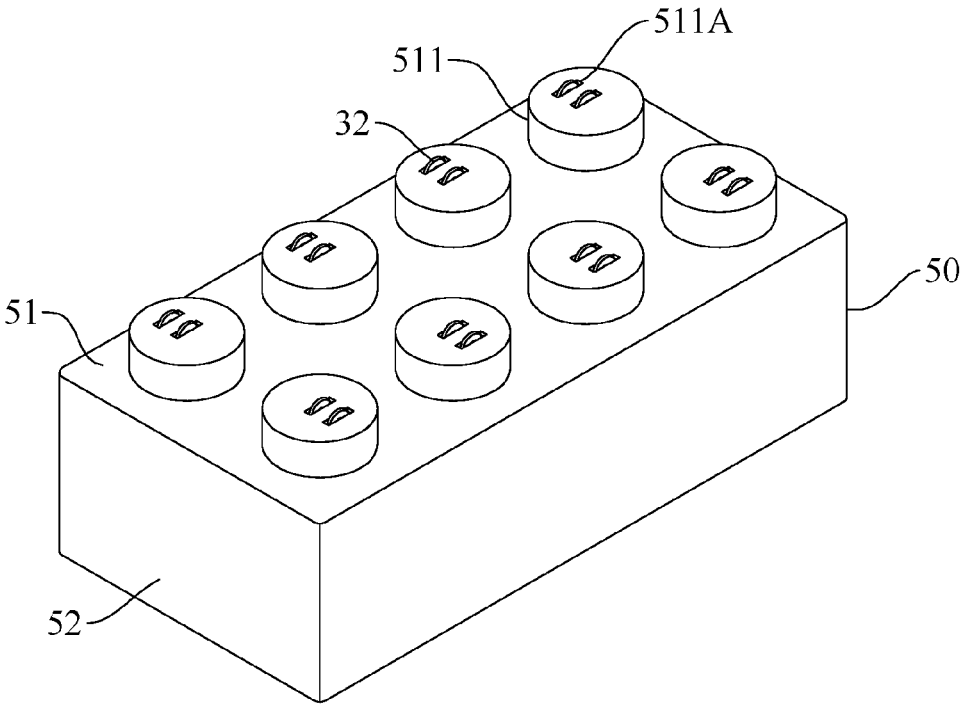
FIG. 1 is a perspective view showing an illuminating building block with high light transmission having a positioning structure for a sheet-shaped electric connection member according to a first preferred embodiment of the present invention.

The embodiments of the present invention are described in detail with reference to the attached drawings, and like reference numerals in the attached drawings denote like elements.

With reference to the drawings and in particular to FIGS. 1 to 4, an illuminating building block with high light transmission having a positioning structure for a sheet-shaped electric connection member according to a first preferred embodiment of the present invention includes a base 10, a circuit board 20, a plurality of electric connection members 30, an illuminating member 40 and a top cover 50.

The base 10 has a rectangular plate structure and includes a top surface 11 and a bottom surface 12. There are eight recesses 13 disposed between the top surface 11 and a bottom surface 12, and penetrating through the base 10. The recesses 13 are arranged in two rows of four spaced apart recesses 13. Two positioning posts 14 are located between the two rows of the recesses 13, and are projected from the top surface 11 of the base 10 in a direction away from the base 10. The base 10 includes a plurality of grooves 15 disposed at peripheries thereof. Each of the grooves 15 is provided with an engaging piece 151 disposed at a side adjacent to the top surface 11 of the base 10.

The circuit board 20 is disposed on the top surface 11 of the base 10 and includes a LED position dropping hole 21 and two positioning holes 22. Positions, shapes and sizes of the two positioning holes 22 are corresponding to those of the two positioning posts 14 of the base 10. The two positioning posts 14 pass through the two positioning holes 22, respectively, thereby fixing the positions of the base 10 and the circuit board 20 relative to each other. Further referring to FIG. 4, the circuit board 20 includes an electrode circuit 23 disposed at a side facing the base 10. Arrangement patterns of the electrode circuit 23 are corresponding to the positions of the eight recesses 13 of the base 10.

Two ends of the electrode circuit 23 are connected with the electric connection members 30, respectively. The electric connection members 30 are extended in a direction away from the base 10. The electric connection member 30 is integrally formed and has a thin sheet-shaped structure. Each of the electric connection members 30 includes a projection portion 31, four elastic pieces 32 and a connection portion 33. The connection portion 33 is connected with the four elastic pieces 32 and has one end connected with the projection portion 31. The end of the projection portion 31 away from the connection portion 33 includes a bending section 311. The bending sections 311 are bended along the circuit board 20 and are located corresponding to the ends of the electrode circuit 23 of the circuit board 20, so that the electrode circuit 23 is contacted with the bending sections 311 and the electrode circuit 23 is electrically connected with the electric connection members 30.

The illuminating member 40 is mounted on the electrode circuit 23 of the circuit board 20 and is disposed at a position corresponding to the LED position dropping hole 21 in the circuit board 20, so that the illuminating member 40 can enlarge the illuminating area on the top cover 50.

Figure 4:
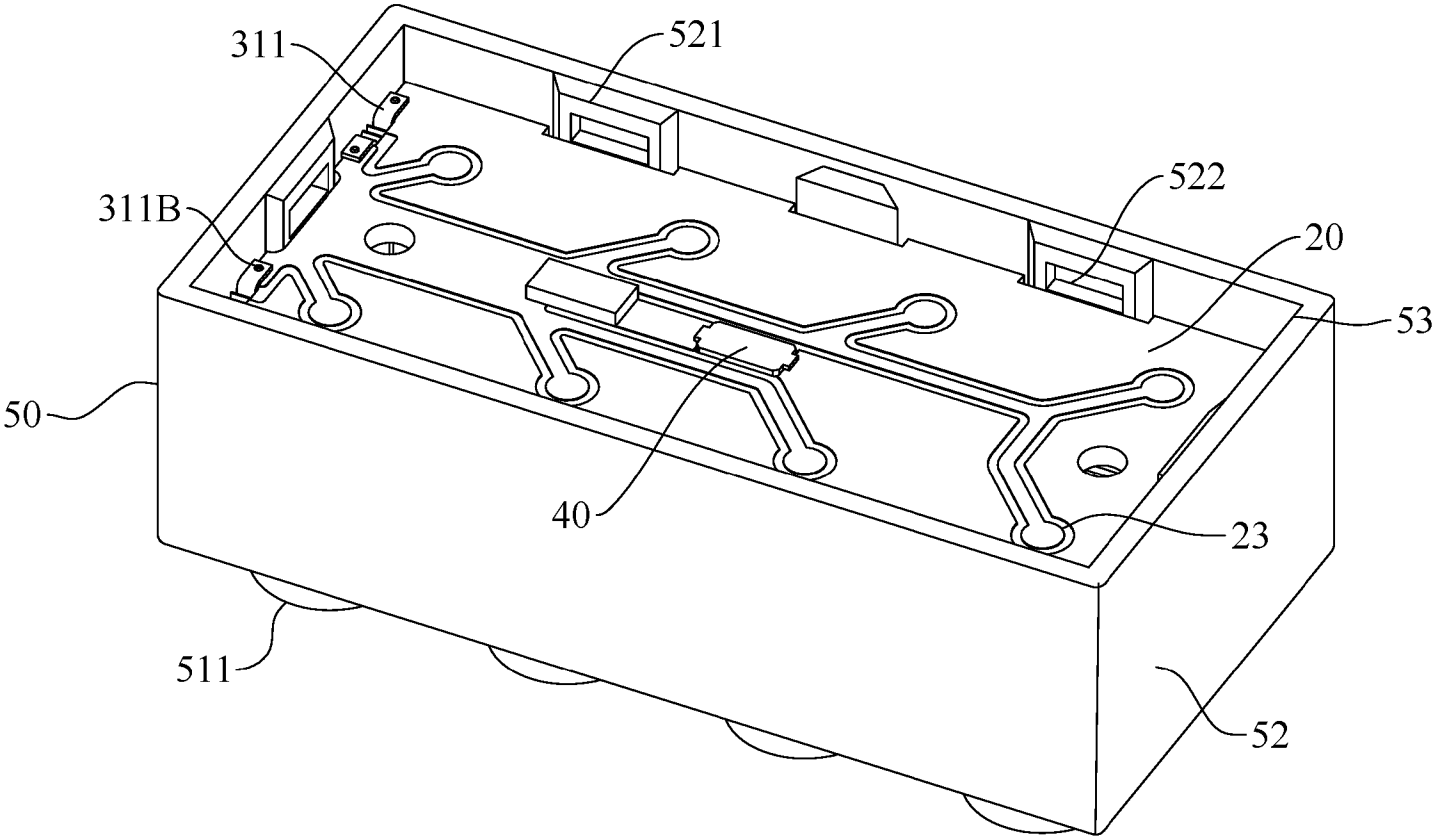
FIG. 4 is a perspective view from a bottom angle showing the illuminating building block with high light transmission according to the first preferred embodiment of the present invention.
Figure 5:
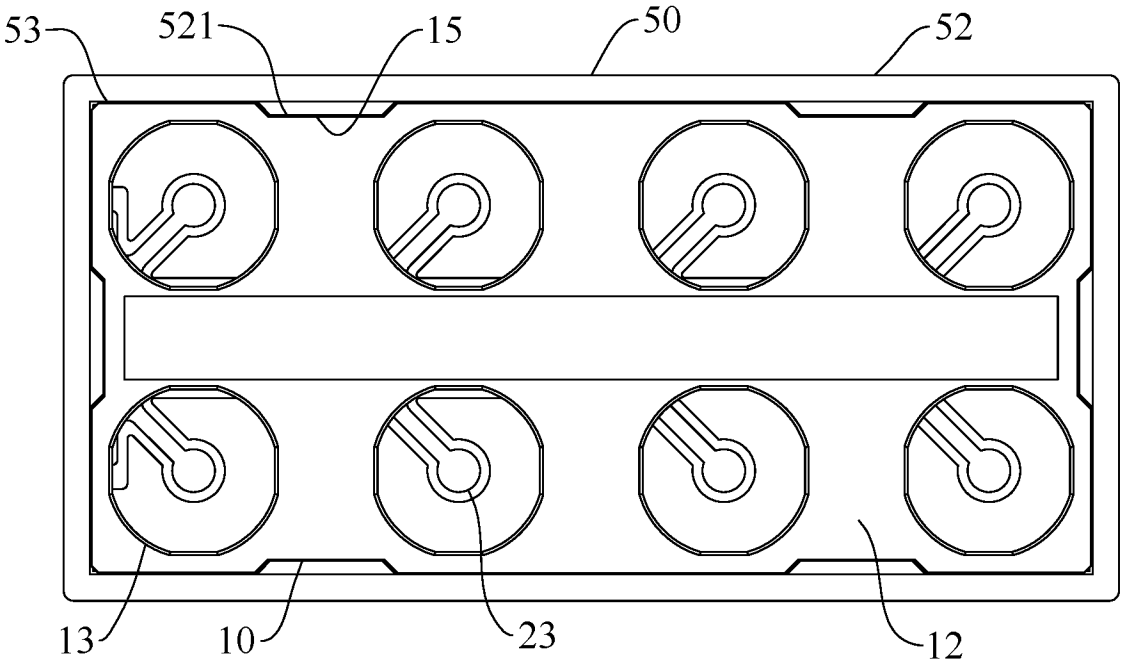
FIG. 5 is a bottom view showing the illuminating building block with high light transmission according to the first preferred embodiment of the present invention.

The top cover 50 is a hollow and light transmittable element. The top cover 50 is disposed above the base 10, the circuit board 20 and the electric connection members 30. The top cover 50 includes a top portion 51, a side portion 52 and a bottom opening 53. The top portion 51 includes eight hollow studs 511 whose positions are corresponding to those of the eight recesses 13 of the base 10 and the elastic pieces 32 of the electric connection members 30, so that the elastic pieces 32 can projected from an interior of the top cover 50 into the hollow studs 511 and then projected out of the top cover 50. More particularly, each of the hollow studs 511 includes two penetrating-through elongated holes 511A disposed at a side away from the top portion 51. Positions of the two elongated holes 511A are respectively corresponding to those of the elastic pieces 32 of the electric connection members 30, so that the elastic pieces 32 are projected out of the elongated holes 511A. When the illuminating building blocks with high light transmission according to the present invention are connected with each other, the elastic pieces 32 projected from one illuminating building block are contacted with and electrically connected with the electrode circuit 23 of the circuit board 20 of another illuminating building block. The side portion 52 is extended from an edge of the top portion 51 in a direction toward the base 10 to form the bottom opening 53 that is disposed at a side opposite to the top portion 51. Therefore, an accommodating space 70 is defined between the base 10 and the top cover 50, so that the circuit board 20, the electric connection members 30 and the illuminating member 40 are received in the accommodating space 70. As shown in FIG. 5, an interior surface of the side portion 52 includes a plurality of protrusion bumps 521 disposed at a side adjacent to the bottom opening 53. Each of the protrusion bumps 521 is provided with an engaging indentation 522 as shown in FIG. 4. The sizes, shapes and the positions of the engaging indentations 522 of the protrusion bumps 521 of the top cover 50 are corresponding to those of the engaging pieces 151 of the base 10, so that the base 10 can be engaged with the top cover 50 and the engagement between them is less likely to get loose.

Figure 2:
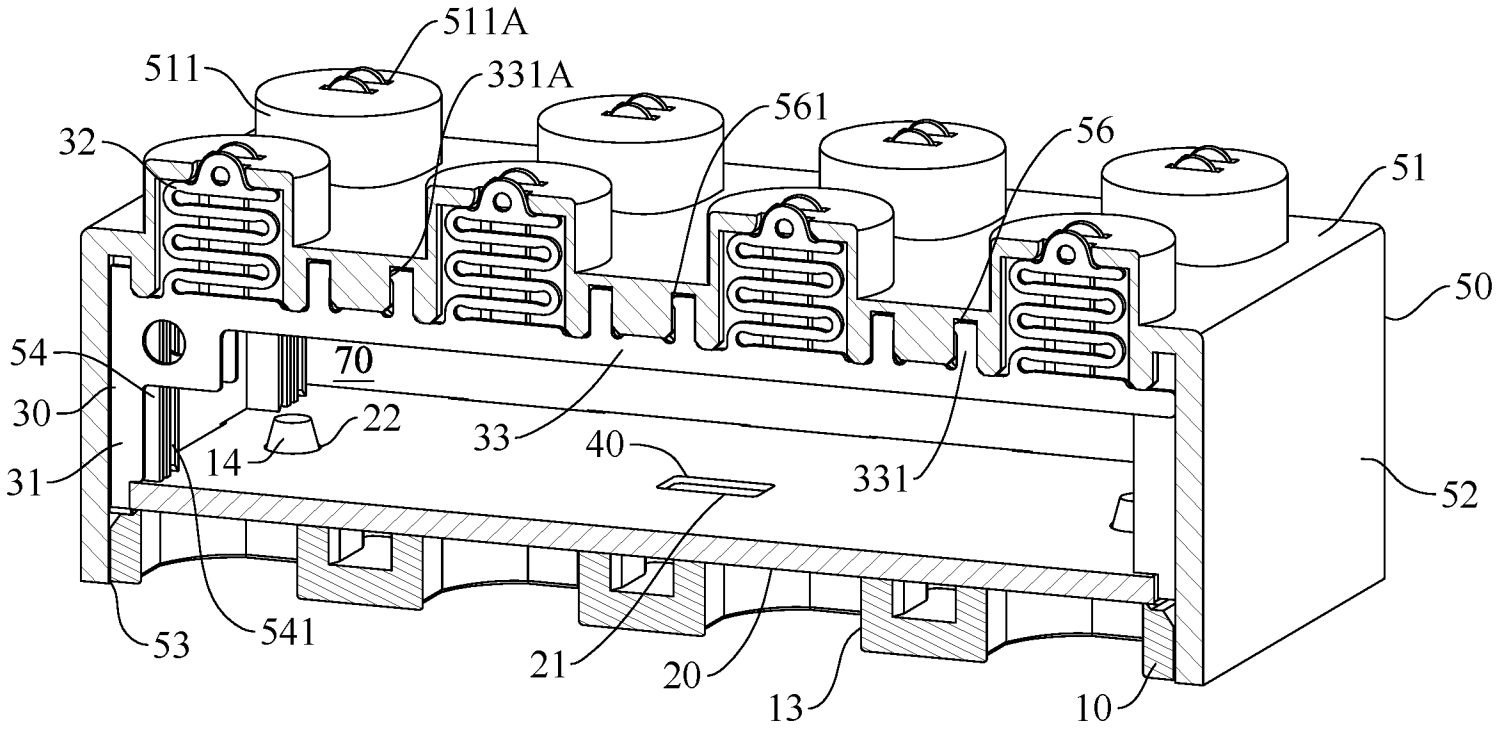
FIG. 2 is a cross sectional view showing the illuminating building block with high light transmission according to the first preferred embodiment of the present invention.
Figure 3:
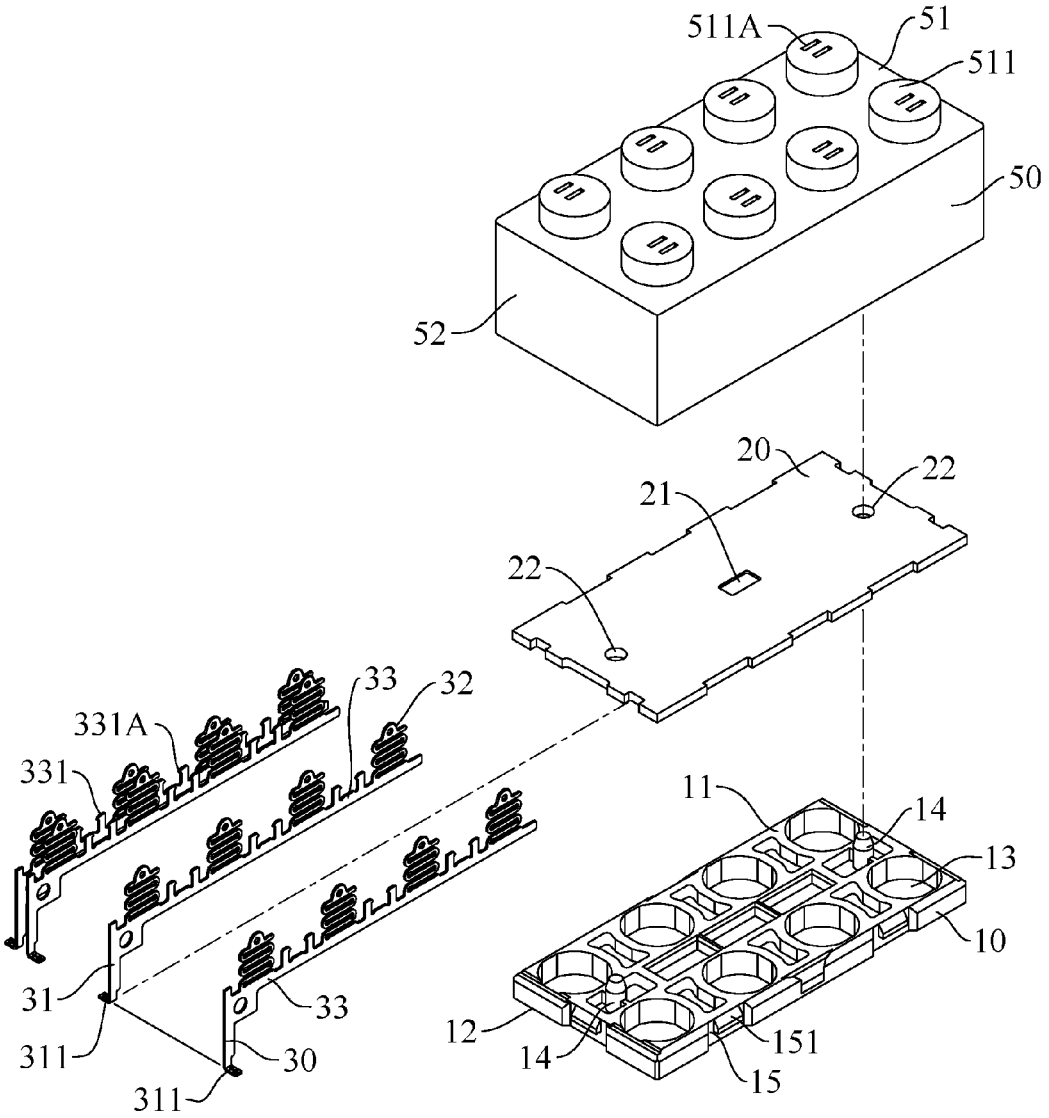
FIG. 3 is an exploded view showing the illuminating building block with high light transmission according to the first preferred embodiment of the present invention.

Referring to FIG. 2, the side portion 52 of the top cover 50 further includes a plurality of projection strips 54 projected from the interior surface of the side portion 52 toward the accommodating space 70 and arranged at intervals. A plurality of slots 541 are defined between the projection strips 54 and are disposed spaced away from each other, thereby allowing the projection portions 31 of the electric connection members 30 to be inserted from the bottom opening 53 into the slot 541. The slots 541 make it easier to fix the electric connection members 30. The slots 541 also provide preliminary positioning arrangement between the elastic pieces 32 of the connection members 30 and the elongated holes 511A of the hollow studs 511 of the top cover 50, thereby aligning the elastic pieces 32 with the elongated holes 511A of the hollow studs 511 and facilitating the elastic pieces 32 being projected from the accommodating space 70 out of the top cover 50. Moreover, the projection strips 54 and the slots 541 prevent the misalignment between the elastic pieces 32 and the elongated holes 511A of the hollow studs 511, which affects the power transmission between the connected illuminating building blocks due to the elastic pieces 32 being pressed by the top cover 50 or the hollow studs 511, constricted in the accommodating space 70 and incapable of projecting out of the top cover 50.

Moreover, the top portion 51 of the top cover 50 includes a plurality of engaging recesses 56 disposed at a side facing the electric connection members 30. Each of the engaging recesses 56 has a depression 561 disposed therein. The connection portion 33 of the electric connection member 30 includes a plurality of projection pieces 331 disposed at a side facing the top portion 51 of the top cover 50. Each of the projection pieces 331 is further provided with a projection point 331A disposed at a side facing the top portion 51 of the top cover 50. The sizes, shapes and positions of the engaging recesses 56 are corresponding to those of the projection pieces 331; and the sizes, shapes and positions of the depressions 561 of the engaging recesses 56 are corresponding to those of the projection points 331A of the projection pieces 331. Because the projection points 331A of the projection pieces 331 are correspondingly engaged with the depressions 561 of the engaging recesses 56, the projection pieces 331 and the engaging recesses 56 make it easier to engage the electric connection members 30 with the top cover 50 and simultaneously make it easier to align the elastic pieces 32 of the electric connection members 30 with the elongated holes 511A of the hollow studs 511 of the top cover 50.

Figure 6:
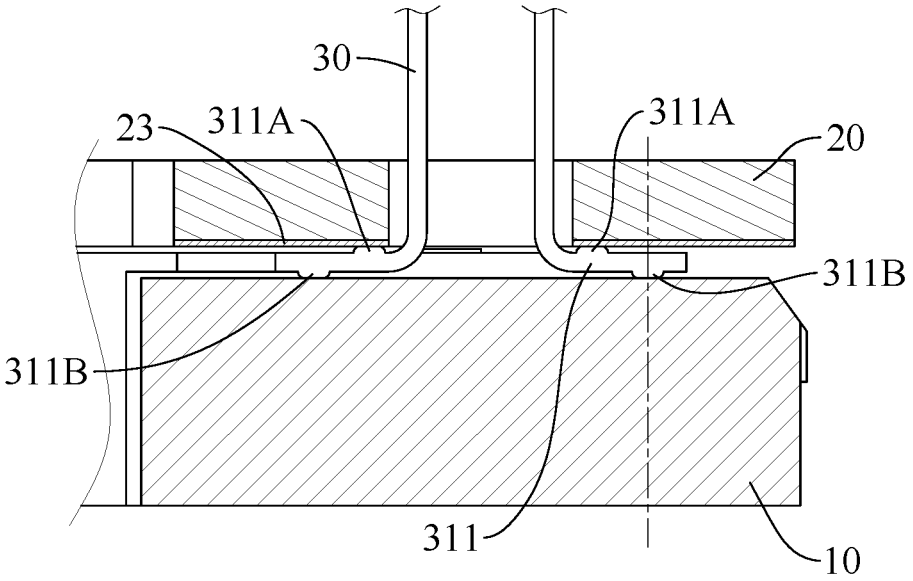
FIG. 6 is a detailed view showing the engagement between a base and a circuit board of the illuminating building block with high light transmission according to the first preferred embodiment of the present invention.

Referring to FIGS. 4 and 6, each of the bending sections 311 of the electric connection members 30 includes a first bump 311A disposed at a side facing the electrode circuit 23 of the circuit board 20, and a second bump 311B disposed at a side facing the base 10. The first bump 311A and the second bump 311B are contacted with the electrode circuit 23 of the circuit board 20 and the base 10, respectively. When the base 10 is assembled to the top cover 50 in a direction from the bottom opening 53 of the top cover 50 toward the circuit board 20, the bending sections 311 of the electric connection members 30 are sandwiched in between the base 10 and the circuit board 20. The second bumps 311B of the bending sections 311 are pressed by the base 10 to force the first bump 311A of the bending section 311 to be securely contacted with the electrode circuit 23 of the circuit board 20. Due to the dimensional tolerances generated during manufacturing the illuminating building blocks with high light transmission having a positioning structure for a sheet-shaped electric connection member, the bending sections 311 of the electric connection members 30 sometimes cannot be securely contacted with the electrode circuit 23 on the circuit board 20, which affects the conductivity and the yield of the products. The first bumps 311A and the second bumps 311B can prevent the poor electric connection between elements.

Figure 7:
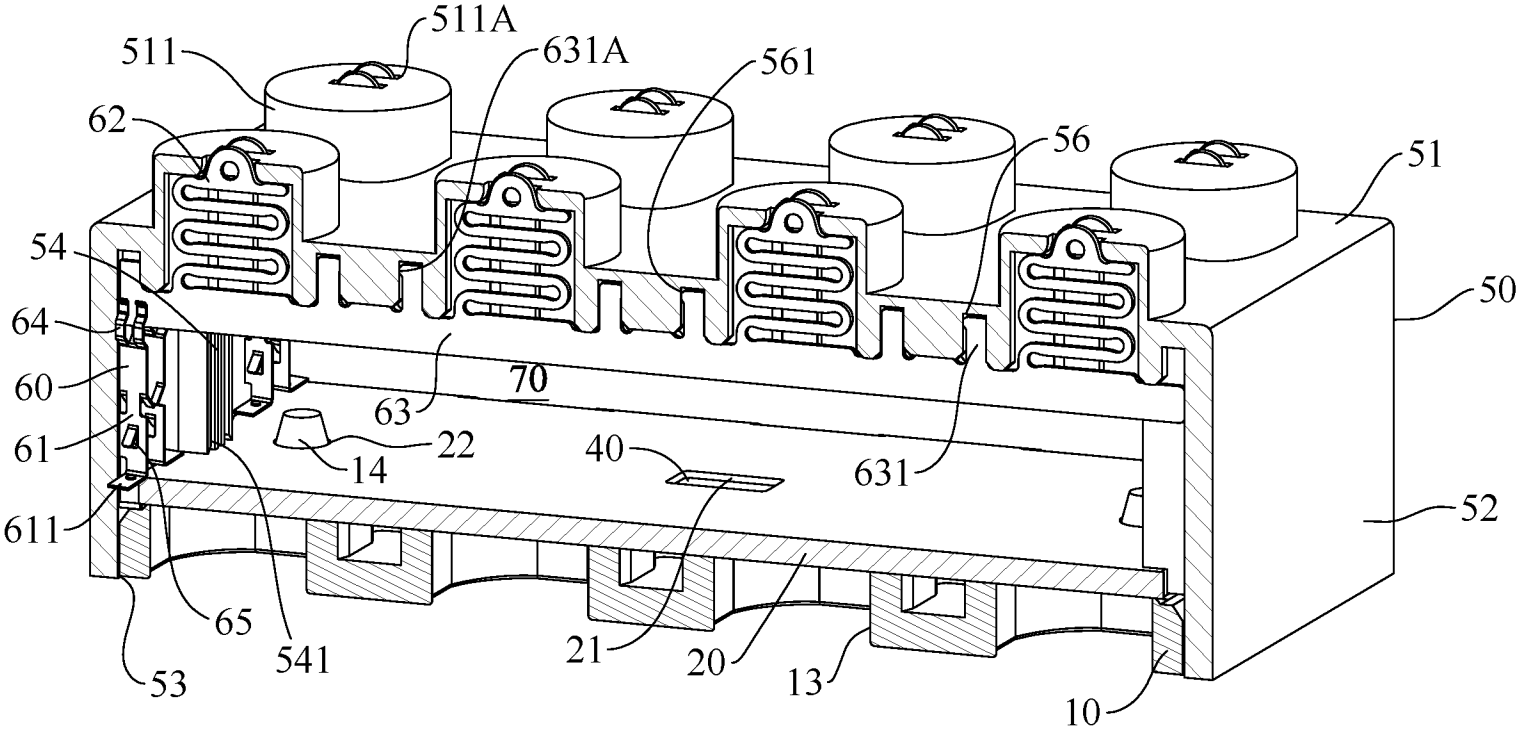
FIG. 7 is a cross sectional view showing a two-piece type of illuminating building block with high light transmission having a positioning structure for a sheet-shaped electric connection member according to a second preferred embodiment of the present invention.
Figure 8:
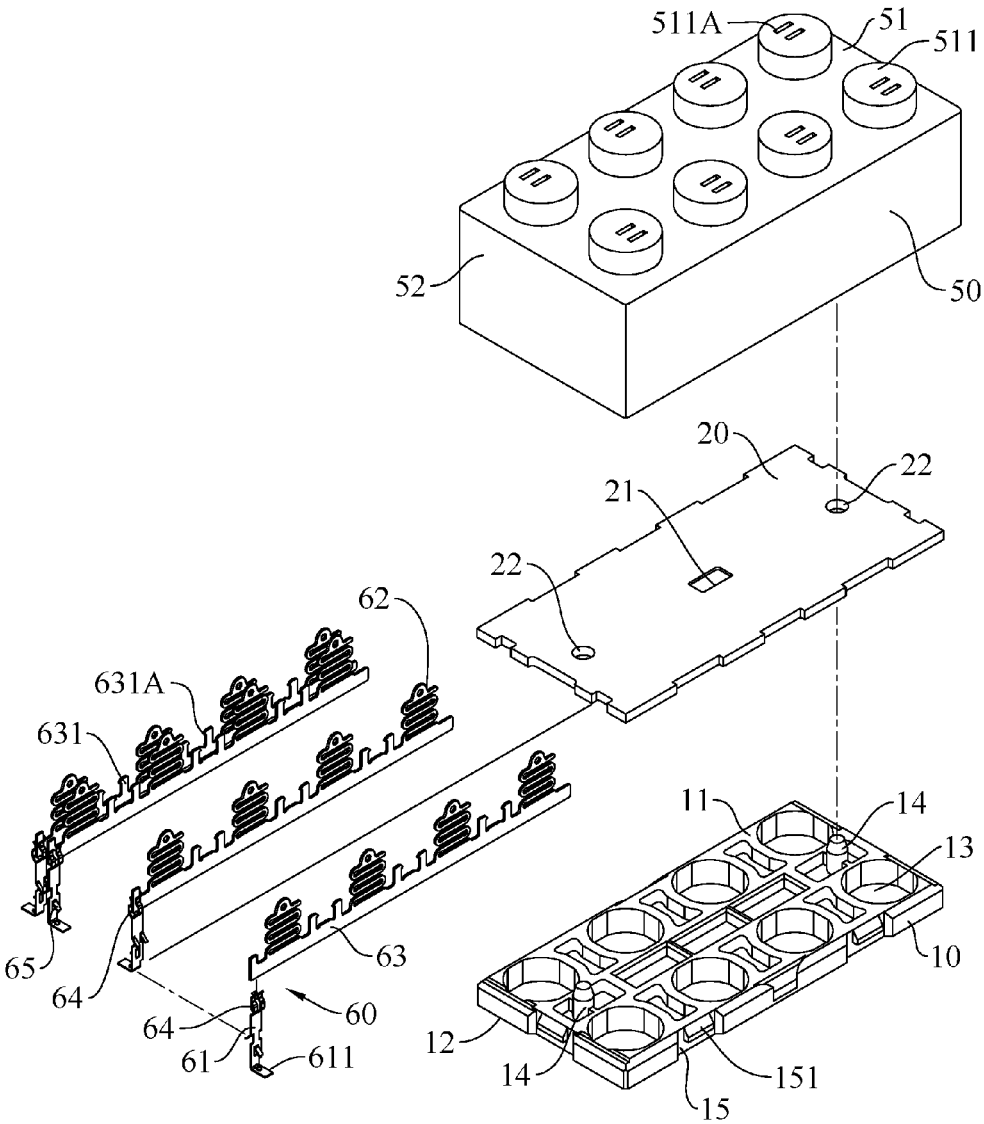
FIG. 8 is an exploded view showing the two-piece type of illuminating building block with high light transmission according to the second preferred embodiment of the present invention.

Referring to FIGS. 7 and 8, a two-piece type of electric connection member 60 according to a second preferred embodiment includes a projection portion 61, four elastic pieces 62 and a connection portion 63, wherein the elastic pieces 62 and the connection portion 63 have an integrally formed sheet-shaped structure, and the projection portion 61 is a separated and removable element. The projection portion 61 includes a clip device 64 disposed at an end adjacent to the connection portion 63. The clip device 64 is removably connected with the connection portion 63, thereby forming the electric connection therebetween.

After the projection portion 61 is connected with the connection portion 63 by the clip device 64, the connection portion 63 connects the projection portion 61 with the four elastic pieces 62. The end of the projection portion 61 away from the connection portion 63 also includes a bending section 611. The bending sections 611 are bended along the circuit board 20 and are located corresponding to the ends of the electrode circuit 23 of the circuit board 20, so that the electrode circuit 23 is contacted with the bending sections 611 and electrically connected with the two-piece type of electric connection members 60.

Figure 9:
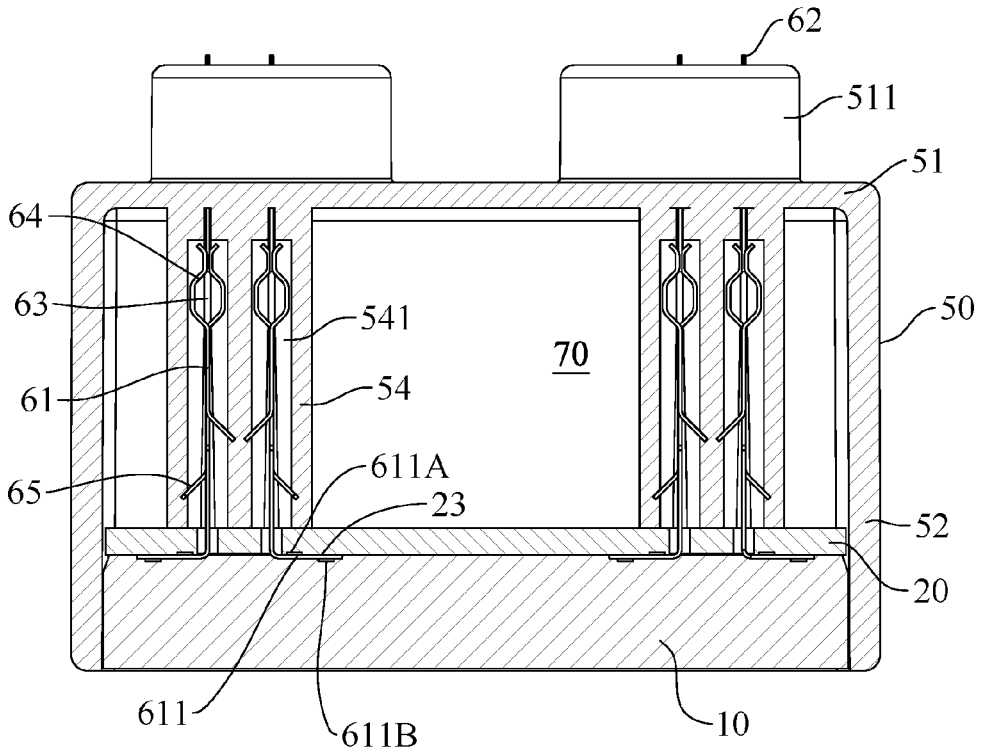
FIG. 9 is a side cross sectional view showing the two-piece type of illuminating building block with high light transmission according to the second preferred embodiment of the present invention.

Furthermore, the projection portion 61 is provided with a plurality of pressing pieces 65 extended away from the projection portion 61. When the two-piece type of electric connection members 60 are inserted into the slots 541 of the top cover 50, the pressing pieces 65 are spread out and then pressed against surfaces of the slots 541 as shown in FIG. 9. The pressing pieces 65 facilitate the projection portions 61 to be fixed in the slots 541 and make the projection portions 61 less likely to get loose.

The configurations of the four elastic pieces 62 and the connection portion 63 of the two-piece type of electric connection member 60 are the same as those of the four elastic pieces 32 and the connection portion 33 of the electric connection member 30. The connection portion 63 of the two-piece type of electric connection member 60 includes a plurality of projection pieces 631 disposed at a side facing the top portion 51 of the top cover 50. Each of the projection pieces 631 is further provided with a projection point 631A disposed at a side facing the top portion 51 of the top cover 50. The sizes, shapes and positions of the engaging recesses 56 are corresponding to those of the projection pieces 631; and the sizes, shapes and positions of the depressions 561 of the engaging recesses 56 are corresponding to those of the projection points 631A of the projection pieces 631. Because the depressions 561 of the engaging recesses 56 of the top cover 50 are correspondingly engaged with the projection points 631A of the projection pieces 631 of the two-piece type of electric connection members 60, the engaging recesses 56 and the projection pieces 631 make it easier to engage the two-piece type of electric connection members 60 with the top cover 50 and simultaneously make it easier to align the elastic pieces 62 of the two-piece type of electric connection members 60 with the elongated holes 511A of the hollow studs 511 of the top cover 50.

Moreover, each of the bending sections 611 of the two-piece type of electric connection members 60 includes a first bump 611A disposed at a side facing the electrode circuit 23 of the circuit board 20, and a second bump 611B disposed at a side facing the base 10. The first bump 611A and the second bump 611B are contacted with the electrode circuit 23 of the circuit board 20 and the base 10, respectively. When the base 10 is assembled to the top cover 50 in a direction from the bottom opening 53 of the top cover 50 toward the circuit board 20, the bending sections 611 of the two-piece type of electric connection members 60 are sandwiched in between the base 10 and the circuit board 20. The second bumps 611B are pressed by the base 10 to force the first bump 611A of the bending section 611 to be securely contacted with the electrode circuit 23 of the circuit board 20. Due to the dimensional tolerances generated during manufacturing the illuminating building blocks with high light transmission having a positioning structure for a sheet-shaped electric connection member, the bending sections 611 of the electric connection members 60 sometimes cannot be contacted with the electrode circuit 23 on the circuit board 20, which affects the conductivity and the yield of the products. The first bumps 611A and the second bumps 611B can prevent the poor electric connection between elements.

Figure 10:
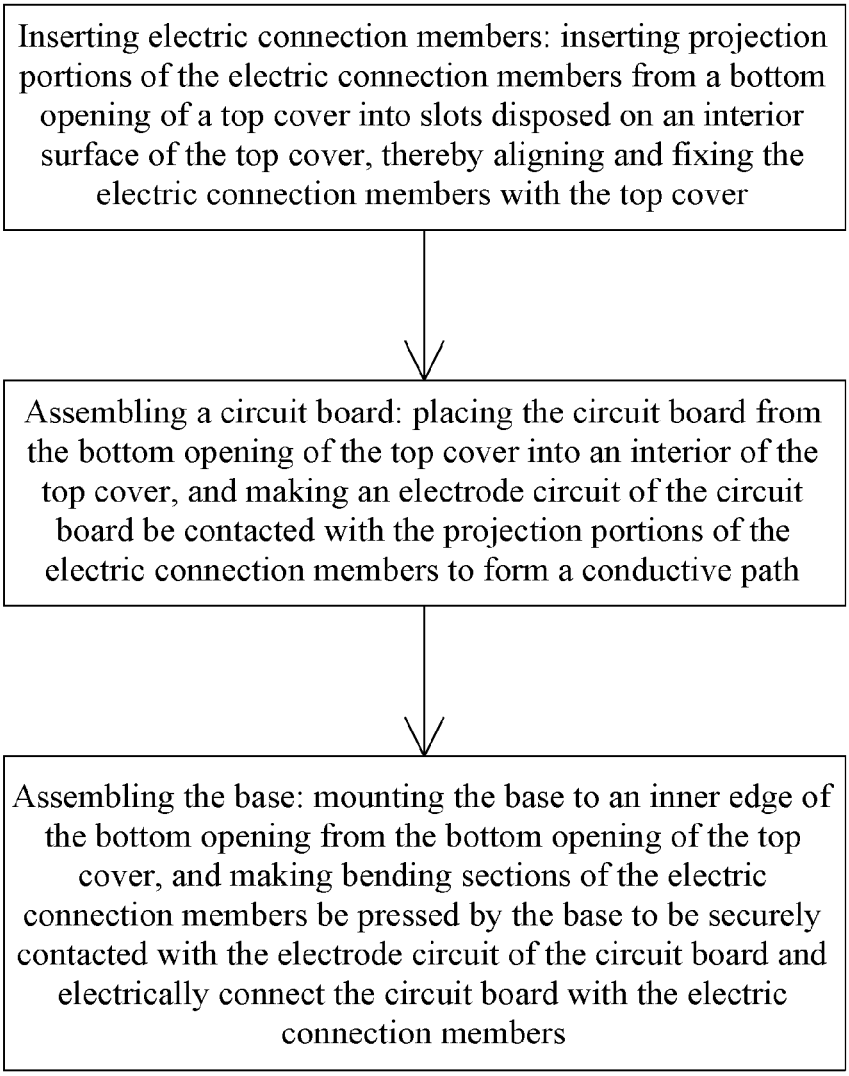
FIG. 10 is a flow chart showing a method of assembling an illuminating building block with high light transmission having a positioning structure for a sheet-shaped electric connection member according to the present invention.
Figure 11:
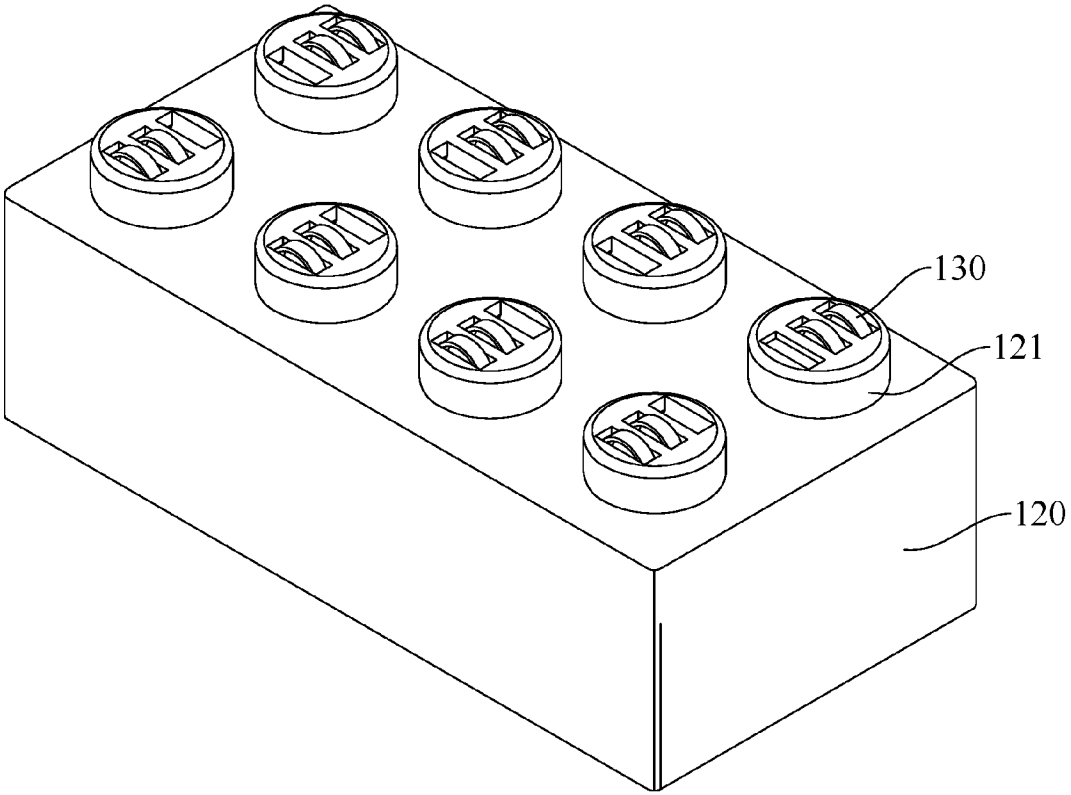
FIG. 11 (PRIOR ART)
FIG. 11 a perspective view showing a conventional illuminating building block with high light transmission.
Figure 12:
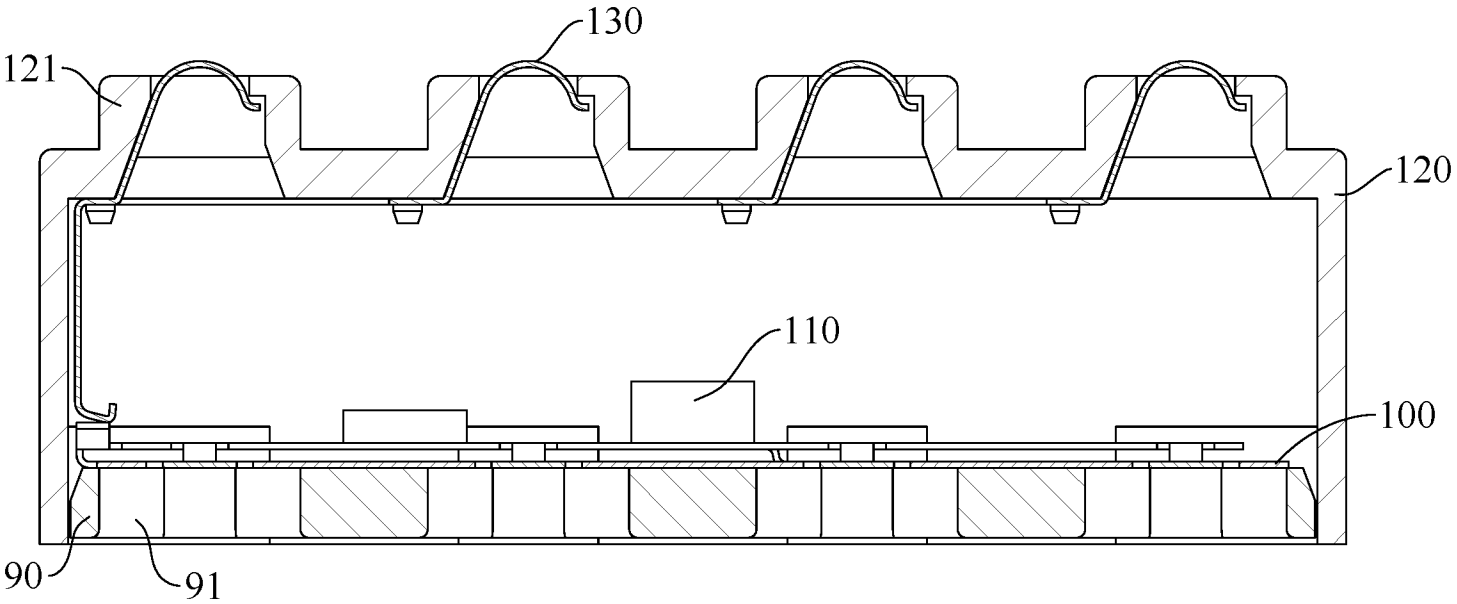
FIG. 12 (PRIOR ART)
FIG. 12 is a cross-sectional view showing the conventional illuminating building block with high light transmission.

Referring to FIG. 10, corresponding to the illuminating building blocks with high light transmission mentioned above, a method of assembling an illuminating building block with high light transmission having a positioning structure for a sheet-shaped electric connection member according to the present invention includes the steps of:

The first step of the method is inserting electric connection members 30. Projection portions 31 of the electric connection members 30 are inserted into a top cover 50 from a bottom opening 53 of the top cover 50 along slots 541 disposed on an interior surface of a side portion 52 of the top cover 50 toward a top portion 51 of the top cover 50, and inserting projection pieces 331 of the electric connection members 30 into engaging recesses 56 of the top cover 50. Thus, projection points 331A of the projection pieces 331 of the electric connection members 30 are engaged with depressions 561 of the engaging recesses 56 of the top cover 50. Therefore, the electric connection members 30 are engaged with the top cover 50 and elastic pieces 32 of the electric connection members 30 are projected out of elongated holes 511A of hollow studs 511 of the top covers 50.

The second step of the method is assembling a circuit board 20. The circuit board 20 is placed from the bottom opening 53 of the top cover 50 into an interior of the top cover 50, and an electrode circuit 23 of the circuit board 20 is contacted with ends of the projection portions 31 of the electric connection members 30, thereby forming a conductive path.

The third step of the method is assembling a base 10. The base 10 is mounted to an inner edge of the bottom opening 53 of the top cover 50 from the bottom opening 53 of the top cover 50 to seal the circuit board 20 and the electric connection members 30 in the top cover 50, and bending sections 311 of the electric connection members 30 are pressed by the base 10 to be securely contacted with the electrode circuit 23 of the circuit board 20. Therefore, the circuit board 20 is electrically connected with the electric connection members 30, and the connected illuminating building blocks with high light transmission having a positioning structure for a sheet-shaped electric connection member according to the present invention can illuminate together.

In summary, the illuminating building block with high light transmission having a positioning structure for a sheet-shaped electric connection member and the method of assembling the same according to the present invention take advantage of the projection strips 54 disposed on the interior surface of the side portion 52 of the top cover 50 to form the slots 541 in which the projection portions 31 of the electric connection members 30 are inserted. This configuration facilitates the alignment between the elastic pieces 32 of the electric connection members 30 and the elongated holes 511A of the hollow studs 511, so that the elastic pieces 32 are accurately positioned and projected out of the hollow studs 511. Furthermore, the elastic pieces 32 projected from one illuminating building block can be contacted with and electrically connected with the electrode circuit 23 of another illuminating building block.

Moreover, the projection pieces 331 of the electric connection members 30 and the engaging recesses 56 of the top cover 50 are corresponding to each other, and the projection points 331A of the projection pieces 331 and the depressions 561 of the engaging recesses 56 are corresponding to each other. Thus, the projection pieces 331 are engaged with the engaging recesses 56 and the projection points 331A are engaged with the depressions 561, thereby securely connecting the top cover 50 with the electric connection members 30. This configuration not only aligns the elastic pieces 32 with the elongated holes 511A of the hollow studs 511, but also effectively prevents the elastic pieces 32 of the electric connection members 30 from descending due to gravity and thus being incapable of being projected out of the hollow studs 511. Therefore, each of the elastic pieces 32 can be projected out of the hollow studs 511 after the illuminating building block with high light transmission according to the present invention is assembled. Accordingly, the yield of the illuminating building blocks with high light transmission according to the present invention increases. The connected illuminating building blocks with high light transmission having a positioning structure for a sheet-shaped electric connection member according to the present invention is less like to break circuit and effectively overcome the regular problems of circuit transmission of the conventional illuminating building blocks with high light transmission.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An illuminating building block with high light transmission having a positioning structure for a sheet-shaped electric connection member, comprising:

a base including at least two recesses defined therethrough;

a top cover being hollow and light transmittable, mounted on the base, including a top portion, a side portion and a bottom opening, the top portion including at least two hollow studs corresponding to the recesses of the base, the side portion extended from an edge of the top portion in a direction toward the base and connected with an edge of the base, the side portion including a plurality of projection strips disposed on at least one interior surface of the side portion, the projection strips projected from the interior surface of the side portion toward an interior of the top cover and arranged at intervals, a plurality of slots provided between the projection strips and disposed spaced away from each other, the bottom opening being surrounded by the side portion;

a circuit board disposed on a top of the base, the circuit board including at least one electrode circuit disposed at a side facing the base and corresponding to positions of the recesses, the electrode circuit being electrically connected with at least one electric connection member that is extended in a direction towards the top portion, wherein the electric connection member has a sheet-shaped structure, the electric connection member includes a projection portion, at least two elastic pieces and a connection portion, the projection portion has two ends, one end of the projection portion is electrically connected with the electrode circuit and another end of the projection portion is connected with the connection portion, the projection portion of the electric connection member is inserted into the slot, the elastic pieces are projected out of the hollow studs, and the connection portion connects the projection portion with the elastic pieces; and at least one illuminating member mounted on the circuit board.

2. The building block according to claim 1, wherein the connection portion includes at least one projection piece disposed at a side facing the top portion of the top cover, and the top portion includes at least one engaging recess disposed at a side facing the electric connection member, the projection piece is corresponding to and engaged with the engaging recess.

3. The building block according to claim 2, wherein the engaging recess includes a depression disposed therein, the projection pieces includes a projection point disposed at the side facing the top portion, and the depression is corresponding to and engaged with the projection point.

4. The building block according to claim 1, wherein the projection portion, the elastic pieces and the connection portion of the electric connection member has an integrally formed sheet-shaped structure.

5. The building block according to claim 1, wherein the elastic pieces and the connection portion have an integrally formed sheet-shaped structure, the projection portion includes a clip device disposed at an end adjacent to the connection portion, and the clip device is removably connected with the connection portion.

6. The building block according to claim 1, wherein the projection portion includes a bending section disposed at an end electrically connected with the electrode circuit, and the bending section is bended along and contacted with the circuit board.

7. The building block according to claim 6, wherein the bending sections includes a first bump disposed at a side facing the circuit board and contacted with the electrode circuit, and a second bump disposed at a side facing the base and contacted with the base.

8. The building block according to claim 1, wherein the base includes a plurality of grooves disposed at peripheries thereof, and each of the grooves is provided with an engaging piece, and the interior surface of the side portion of the top cover includes a plurality of protrusion bumps disposed at a side adjacent to the base, each of the protrusion bumps includes an engaging indentation, the engaging pieces are corresponding to and engaged with the engaging indentations.

9. A method of assembling the illuminating building block with high light transmission having a positioning structure for a sheet-shaped electric connection member of claim 1, comprising the steps of:

inserting the electric connection member: inserting the projection portion of the electric connection member into the top cover from the bottom opening of the top cover along the slot disposed on the interior surface of the side portion of the top cover toward the top portion of the top cover, and projecting the elastic pieces of the electric connection member out of the hollow studs of the top cover;

assembling the circuit board: placing the circuit board from the bottom opening into the interior of the top cover, and making the at least one electrode circuit of the circuit board be contacted with the end of the projection portion of the electric connection member, thereby forming a conductive path; and assembling the base: mounting the base to an inner edge of the bottom opening from the bottom opening of the top cover.

10. A method for assembling the illuminating building block with high light transmission having a positioning structure for a sheet-shaped electric connection member of claim 2, comprising the steps of:

inserting the electric connection member: inserting the projection portion of the electric connection member into the top cover from the bottom opening of the top cover along the slot disposed on the interior surface of the side portion of the top cover toward the top portion of the top cover, inserting the projection piece of the electric connection member into the engaging recess of the top cover, thereby engaging the electric connection member with the top cover and projecting the elastic pieces securely out of the hollow studs of the top cover;

assembling the circuit board: placing the circuit board from the bottom opening into the interior of the top cover, and making the at least one electrode circuit of the circuit board be contacted with the end of the projection portion of the electric connection member, thereby forming a conductive path; and assembling the base: mounting the base to an inner edge of the bottom opening from the bottom opening of the top cover.

* * * * *